US009181864B2

(12) United States Patent
Lank et al.

(10) Patent No.: US 9,181,864 B2
(45) Date of Patent: Nov. 10, 2015

(54) WORK APPARATUS HAVING A FUEL PUMP

(71) Applicant: Andreas Stihl AG & Co. KG, Waiblingen (DE)

(72) Inventors: Jonas Lank, Winnenden (DE); Helmut Zimmermann, Berglen (DE); Klaus-Martin Uhl, Plochingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 13/862,162

(22) Filed: Apr. 12, 2013

(65) Prior Publication Data

US 2013/0276724 A1 Oct. 24, 2013

(30) Foreign Application Priority Data

Apr. 18, 2012 (DE) ..... 10 2012 007 617

(51) Int. Cl.

| | |
|---|---|
| ***F02M 55/02*** | (2006.01) |
| ***F02B 63/02*** | (2006.01) |
| ***F02M 37/00*** | (2006.01) |
| ***F02M 37/04*** | (2006.01) |
| ***F02M 37/16*** | (2006.01) |
| ***F02M 37/18*** | (2006.01) |
| ***F02M 1/16*** | (2006.01) |

(52) U.S. Cl.

CPC ..... *F02B 63/02* (2013.01); *F02M 1/16* (2013.01); *F02M 37/007* (2013.01); *F02M 37/0011* (2013.01); *F02M 37/046* (2013.01); *F02M 37/16* (2013.01); *F02M 37/18* (2013.01)

(58) Field of Classification Search

CPC ..... F02M 17/04; F02M 37/16; F02M 7/08; F02M 69/02; F02M 37/14; F02M 51/04; F02B 63/02; F02B 33/04

USPC ..... 123/2, 468, 469, 446, 495, 179.16, 123/179.11

See application file for complete search history.

(56) References Cited

U.S. PATENT DOCUMENTS

| | | | | |
|---|---|---|---|---|
| 3,250,224 | A * | 5/1966 | Phillips et al. | 417/479 |
| 3,494,343 | A * | 2/1970 | Nutten | 123/179.11 |
| 4,286,553 | A | 9/1981 | Baltz et al. | |
| 4,508,068 | A | 4/1985 | Tuggle et al. | |
| 5,086,742 | A * | 2/1992 | Vogtmann | 123/449 |
| 5,419,686 | A * | 5/1995 | Wissmann et al. | 417/380 |
| 5,560,345 | A * | 10/1996 | Geyer et al. | 123/516 |
| 5,682,845 | A * | 11/1997 | Woody | 123/73 A |
| 5,711,901 | A | 1/1998 | Berg et al. | |
| 6,082,312 | A * | 7/2000 | Singer et al. | 123/41.52 |
| 6,196,170 | B1 | 3/2001 | Singer et al. | |
| 6,494,343 | B2 * | 12/2002 | McManus et al. | 222/55 |

(Continued)

FOREIGN PATENT DOCUMENTS

| | | | |
|---|---|---|---|
| CA | 2251764 | A1 | 4/1997 |

*Primary Examiner* — Lindsay Low
*Assistant Examiner* — Long T Tran
(74) *Attorney, Agent, or Firm* — Walter Ottesen P.A.

(57) ABSTRACT

A work apparatus has an internal combustion engine for driving a work tool of the work apparatus and a fuel pump which is driven by the engine and delivers fuel from a fuel tank to the engine. The work apparatus has a feed pump which is to be actuated manually by the operator. The fuel pump and the feed pump form one assembly which is arranged outside the fuel tank. The fuel tank has a tank wall which delimits the tank interior. An advantageous arrangement and satisfactory cooling of the assembly are achieved if the assembly is arranged at least partially on the tank wall.

19 Claims, 5 Drawing Sheets

(56) References Cited

U.S. PATENT DOCUMENTS

| | | | | |
|---|---|---|---|---|
| 6,595,500 | B2 | 7/2003 | Osburg et al. | |
| 6,938,884 | B2 | 9/2005 | Knaus et al. | |
| 7,743,751 | B2 | 6/2010 | Yonemoto | |
| 7,806,107 | B2 * | 10/2010 | Knauβ et al. | 123/468 |
| 2002/0148419 | A1 * | 10/2002 | Hironaka et al. | 123/73 A |
| 2008/0276911 | A1 * | 11/2008 | Woody | 123/517 |
| 2010/0145595 | A1 * | 6/2010 | Bellistri et al. | 701/103 |
| 2010/0323592 | A1 * | 12/2010 | Nemetz et al. | 451/353 |
| 2013/0146028 | A1 * | 6/2013 | Layher et al. | 123/457 |

* cited by examiner

WORK APPARATUS HAVING A FUEL PUMP

CROSS REFERENCE TO RELATED APPLICATION

This application claims priority of German patent application no. 10 2012 007 617.7, filed Apr. 18, 2012, the entire content of which is incorporated herein by reference.

BACKGROUND OF THE INVENTION

U.S. Pat. No. 6,595,500 discloses a hand-held work apparatus having a diaphragm carburetor. A fuel pump, which is driven by the varying crankcase pressure, and a delivery pump, which is to foe actuated manually, are integrated into the diaphragm carburetor. Carburetors of this type are usually arranged on the internal combustion engine or directly adjacently to the internal combustion engine.

For example, U.S. Pat. No. 4,286,553 also discloses feeding the fuel to an internal combustion engine via an injection valve. The fuel is delivered by a fuel pump to the injection valve.

SUMMARY OF THE INVENTION

It is an object of the invention to provide a work apparatus having an advantageous arrangement of an assembly or a component comprising fuel pump and delivery pump.

The work apparatus of the invention includes: a work tool; a combustion engine configured to drive the work tool; a fuel tank having a tank wall delimiting a tank interior; a fuel pump configured to convey fuel from the fuel tank to the combustion engine; the combustion engine being further configured to drive the fuel pump; a feed pump configured to be manually actuated by a user; and, the fuel pump and the feed pump conjointly defining a component arranged outside of the fuel tank at least partially on the tank wall.

During the operation of the work apparatus, the internal combustion engine heats up greatly. During operation, cooling air which cools the engine is usually delivered by the internal combustion engine. If the fuel pump is heated excessively during the operation of the internal combustion engine and, in particular, also after the internal combustion engine is switched off, when no more cooling air is delivered and the internal combustion engine is still hot, vapor bubbles can be formed. If there are vapor bubbles in the fuel pump, the fuel pump cannot deliver any more fuel, in particular when it is configured as a diaphragm pump. Excessive heating of the fuel pump is therefore to be avoided. This can be achieved in a simple way by virtue of the fact that the component is arranged at least partially on a tank wall which adjoins the tank interior of the fuel tank. The fuel tank is usually arranged in a cool region in a work apparatus, in order to prevent excessive heating of the fuel during operation. During operation, the greatest heat is produced on account of the combustion in the cylinder of the internal combustion engine. The fuel tank is usually arranged at the greatest possible distance from the cylinder of the internal combustion engine, in order to keep the heat input into the fuel tank low. The fuel itself brings about a uniform temperature distribution in the fuel tank and, as a result, satisfactory dissipation of heat, which is input into the fuel tank, via cool regions of the fuel tank to the outside. Excessive heating of the fuel pump can be prevented by way of the arrangement on the tank wall, that is to say immediately adjacently to the tank wall. Heat which is input into the fuel pump can be dissipated via the tank wall of the fuel tank into the fuel and front there via cool regions of the fuel tank to the outside. Moreover, the heat is dissipated to the surrounding air by the fuel pump. The fuel pump is therefore cooled both via the fuel in the fuel tank and via the surrounding air.

The component is advantageously arranged at least partially in a depression of the fuel tank. The arrangement of the component at least partially in a depression of the fuel tank ensures that there is only a small height difference between the delivery pump and the fuel level in the case of a customary parked position of the work apparatus. As a result, the hydrostatic pressure difference which is to be overcome between the fuel, tank and the delivery pump and is a result of the different height position is comparatively low in the case of the arrangement of the component in a depression of the fuel tank. The hydrostatic pressure level between the delivery pump and the fuel tank also differs only a little. As a result, the power output which is required to drive the fuel pump and the force which is to be applied by the operator in order to actuate the delivery pump can be kept low.

In the parked or rest position of the work apparatus, at least approximately 50% of the height of the component, measured in the direction of action of gravity, is advantageously arranged below the uppermost region of the upper side and below the lowermost region of the underside of the fuel tank. At least approximately 50% of the component, in relation to the height of the component, accordingly extends in the region of the fuel tank. At least, approximately 70%, in particular at least approximately 80% of the height of the component is advantageously arranged below the uppermost region of the upper side and below the lowermost region of the underside of the fuel tank, that is to say at a height level between the upper side and the underside of the fuel tank. Accordingly, in the parked position, the component projects beyond the fuel tank in the height direction over at most half, in particular considerably less than half its height. The upper side, the underside and the rear side are delimited by the tank wall here. The upper side, the underside and the rear side of the fuel tank delimit the tank interior. Further regions of the handle housing which, do not delimit the tank interior and are therefore not part of the fuel tank do not represent part of the upper side, the underside or the rear side of the fuel tank.

The depression advantageously extends on the upper side and the rear side of the fuel tank. The rear side of the fuel tank, that is to say that side of the fuel tank which faces away from the tool, is usually a particularly cool region of the fuel tank. The arrangement on the upper side of the fuel tank achieves a situation where the path to the internal combustion engine or to an injection valve which feeds fuel to the internal combustion engine can be kept short, as a result of which the pressure losses between the fuel pump and the injection valve can be kept low. During operation, the internal combustion engine generates vibrations which bring about extensive wetting of the tank wall with fuel, even in the case of a low filling height of the fuel in the fuel tank. As a result, satisfactory cooling of the entire tank wall, in particular also of the upper side of the fuel tank, is achieved by the fuel, even in the case of a low filling height. As a result, the upper side of the fuel tank is a comparatively cool region of the work apparatus, even in the case of a low filling height. The depression is advantageously arranged on that side of the fuel tank which faces away from the internal combustion engine. The fuel tank is particularly cool on this side, since heat is produced during operation, above all, in the cylinder of the internal combustion engine. As a result of the arrangement of the component on that side of the fuel tank which faces away from the internal combustion engine, the component is arranged at a comparatively cool location at a comparatively great spacing from the internal combustion, engine.

A simple construction results if the component is held in a positively locking manner on the fuel tank. As a result, secure fixing of the component can be achieved in a simple way. The positively locking fixing advantageously takes place via a holder. The holder advantageously fixes the position of the component in at least two spatial directions which are perpendicular with respect to one another. As a result, the component can be mounted simply on the fuel tank and is accessible from, the two spatial, directions, with the result that sufficient installation space is available for the operator for operating the delivery pump and for connecting connection lines to the component. The fuel tank is advantageously decoupled in terms of vibration from, the internal combustion engine via at least one anti-vibration element. A simple construction, results if the anti-vibration element is fixed to the holder. Accordingly, in order to fix the component to the fuel tank, a holder is used which is present in any case and serves to fix the anti-vibration element. As a result, the number of required structural elements for the work apparatus can be kept low. However, positively locking fixing can also be carried out in another way, for example via a snap-action connection. In particular, the component is held in a positively locking manner by one or more snap-action elements which are formed integrally on the fuel tank. As a result, additional structural elements for fixing the component in a positively locking manner can be dispensed with, and simple assembly is achieved.

The fuel tank is advantageously integrated onto a handle housing of the work apparatus. Here, at least one handle of the work apparatus is held on the handle housing. The handle is advantageously integrated into the handle housing. The handle housing is a complex component and forms, in particular, a load-bearing housing part of the work apparatus, on which housing part other assemblies such as an engine housing are held. The fuel tank forms a part of the handle housing.

It is provided that the delivery pump has a pump bellows which is to be actuated by the operator. The pump bellows is advantageously arranged, spatially close to at least one further operating element of the work apparatus, in particular to a hand throttle of the work apparatus. The pump bellows is advantageously arranged adjacently to a handle of the work apparatus, in particular adjacently to a rear handle of the work apparatus. A stop switch of the work apparatus is also advantageously arranged adjacently to the pump bellows. The result of the spatially close arrangement of hand throttle, pump bellows and stop switch is simple use which is self-explanatory for the operator. The operating elements are arranged in the immediate spatial vicinity of one another and, as a result, such that they can be found readily and operated readily by the operator. There is an immediate spatial vicinity, in particular, when the operator can hold the rear handle of the work apparatus with his/her hand and, at the same time, can operate the pump bellows and/or the stop switch, for example with the thumb of the same hand.

The component advantageously has a pump housing which confines the fuel pump and the delivery pump. The pump housing is advantageously arranged completely lit the depression in the longitudinal direction of the work apparatus. In the longitudinal direction of the work apparatus, advantageously only the pump bellows projects beyond the rear side of the fuel tank. This results in a pleasant external design of the work apparatus. The integration of the pump housing into the fuel tank can avoid the situation in a simple way where, apart from the pump bellows which is to be actuated by the operator, further parts of the component protrude beyond the housing of the work apparatus, on which further parts the operator might snag himself or herself, or which further parts might interfere with the operator during operation.

The fuel pump is advantageously a diaphragm pump which is driven by the fluctuating pressure in a crankcase of the internal combustion engine.

A simple design results if the pump housing is formed integrally on the fuel tank at least partially. As a result, the number of required components can be reduced. Fuel lines are advantageously also integrated on the fuel tank, with the result that additional connection lines for this purpose can be dispensed with. The component advantageously comprises a pressure regulator which is arranged, in the pump housing and is arranged downstream of the fuel pump in the delivery direction of the fuel. The pressure regulator advantageously has a regulating diaphragm which separates a regulating chamber from a rear space. An advantageous construction results if the rear space is delimited at least partially by the fuel tank.

The tank wall advantageously has a connection opening adjacently to the component. An intake line which connects the tank interior to the fuel pump is advantageously integrated into the component. The fuel pump can foe connected to the tank interior in a simple way via the connection opening and the intake line. This results in a simple construction. An intake line which is configured as a separate hose can be dispensed with. The assembly is simplified, since the intake line does not have to be connected. During the mounting of the component on the fuel tank, the integrated intake line is connected to the connection opening. The seal can be effected in a simple way between the pump housing of the component and the tank wall.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
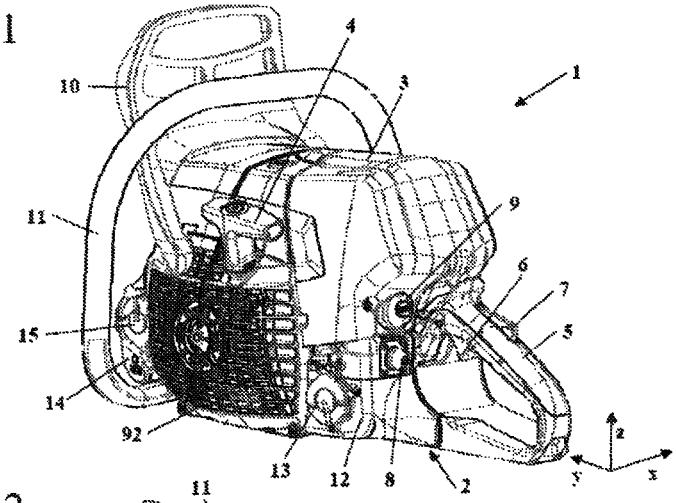
FIG. 1 is a perspective view of a motor-driven chain saw.

As an exemplary embodiment for a work apparatus, FIG. 1 shows a hand-held motor-driven chain saw 1. Instead of the chain saw 1, another hand-held work apparatus can be provided, such as a cutoff machine, a brushcutter or the like. The chain saw 1 has a handle housing 2 and an engine housing 92. A rear handle 5 is formed on the handle housing 2, on which rear handle 5 a hand throttle 6 and a hand throttle lock 7 are pivotably mounted. Moreover, a fuel tank 12 is formed on the handle housing 2, which fuel tank 12 is closed by a tank cap 13.

Figure 2:
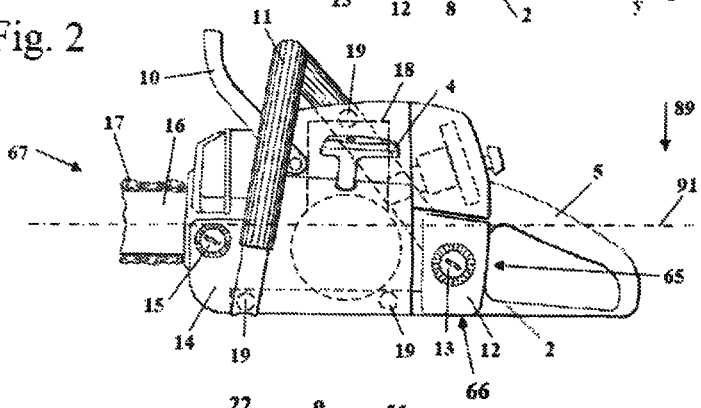
FIG. 2 is a schematic showing a side elevation view of the chain saw of FIG. 1.

As FIG. 2 shows, the handle housing 2 is decoupled in terms of vibration from the engine housing 92 via three anti-vibration elements 19. In addition, further anti-vibration elements can be provided. An internal combustion engine 18 is arranged in the engine housing 92. The starting handle 4 which is shown in FIGS. 1 and 2 serves to start the internal combustion engine 18. The internal combustion engine 18 is covered by the hood 3 which is shown in FIG. 1. The hood 3 can be configured in one piece or in multiple pieces and can cover further components of the chain saw 1, in particular the intake system of the internal combustion engine 18. As FIG. 1 shows, the chain saw 1 has a handle tube 11 which reaches over the hood 3.

As FIG. 2 shows, the chain saw 1 has a guide bar 16, on which a saw chain 17 is arranged which is driven so as to rotate by the internal combustion engine 18. A hand protective bracket 10 is mounted on the engine housing 92 on that side of the handle tube 11 which faces the guide bar 16 and the saw chain 17. The hand protective bracket 10 can serve to actuate a brake device for the saw chain 17. As FIGS. 1 and 2 also show, the chain saw 1 has an oil tank 14 which is closed by a tank cap 15. The oil tank 14 serves to provide lubricating oil for the saw chain 17. As FIG. 1 shows, the chain saw 1 has a pump bellows 8 which is part of a delivery pump which is to be actuated manually and will be described in further detail hereinafter. The pump bellows 8 is arranged in the immediate spatial vicinity of the rear handle 5 and of the hand throttle 6. A stop switch 9 is arranged immediately above the pump bellows 8. The stop switch 9 has a hemispherical, elastic cap which can also be actuated satisfactorily by the operator wearing thick gloves. The shape of the cap of the stop switch 9 corresponds approximately to the shape of the pump bellows 8. The pump bellows 8 and the stop switch 9 are arranged in such a way that the operator can reach the pump bellows 8 or the stop switch 9 with his thumb when his right hand, is arranged on the rear handle 5. The arrangement of pump bellows 8, stop switch 9 and rear handle 5 with the hand throttle 6 and the hand throttle lock 7 in the immediate spatial vicinity of one another makes simple and ergonomic operation possible.

Three spatial directions x, y and z which are oriented perpendicularly with respect to one another are shown in FIG. 1. The first spatial direction (x) extends in the transverse direction of the chain saw 1, that is, in a perpendicular direction with respect to the plane of the guide bar 16. The second spatial direction (y) extends parallel to the longitudinal direction 91 (shown in FIG. 2) of the chain saw 1 from the rear handle 5 in the direction of the guide bar 16. The second spatial direction (y) runs parallel to the plane of the guide bar 16. The third spatial direction (z) stands perpendicularly on the spatial directions x and y and corresponds to the vertical direction. In the usual parked position (shown in FIG. 2) of the chain saw 1 on a flat underlying surface, the third spatial direction (z) runs counter to the direction of action 89 of gravity.

Figure 3:
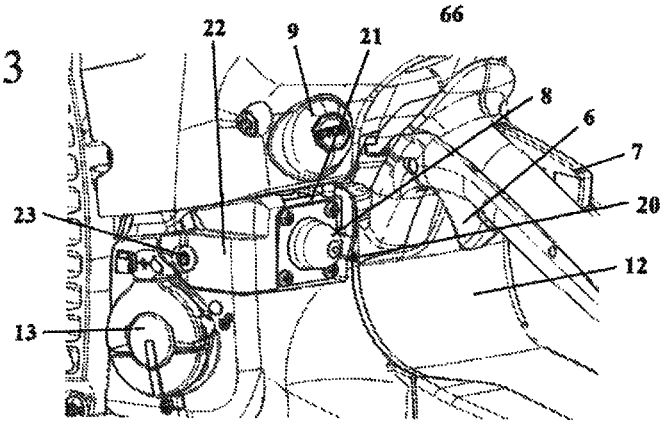
FIG. 3 is a schematic showing an enlarged region of the operating elements of the motor-driven chain saw of FIG. 1.

As FIGS. 1 and 3 show, the fuel tank 12 extends approximately over the entire width of the chain saw 1 as measured in the first spatial direction (x). The fuel tank 12 has a depression 20, in which a pump housing 21 is arranged. The pump bellows 8 projects out of the pump housing 21. The pump housing 21 is held on the fuel tank 12 by a holder 22 in the spatial directions y and z. The holder 22 is fixed on the handle housing 2 by way of a fastening screw 23.

Figure 4:
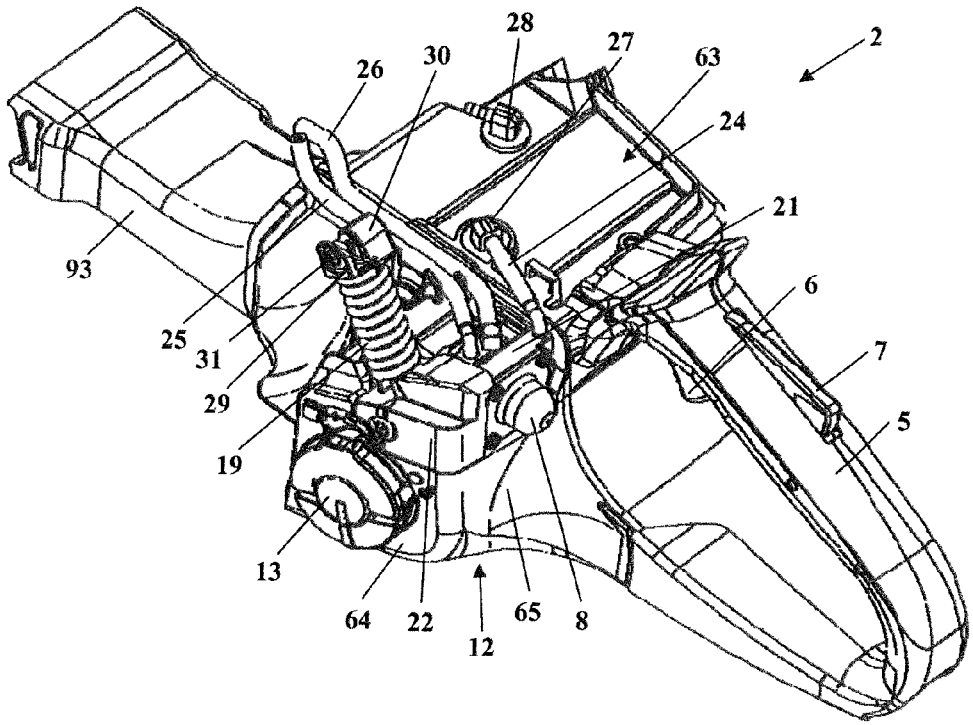
FIG. 4 is a perspective view of the handle housing of the chain saw of FIG. 1.

FIG. 4 shows the configuration of the handle housing 2 in detail. The fuel tank 12 is integrated on the handle housing 2 adjacently to the rear handle 5. An arm 93 projects to the front from the fuel tank 12 on that end which faces away from the rear handle 5. At least one of the anti-vibration elements 19 is fixed on arm 93 for connection, to the engine housing 92 (FIG. 2). The fuel tank 12 has an upper side 63 which, in the usual parked position 67 shown in FIG. 2, lies at the top in relation to the direction of action 89 of gravity. Moreover, the fuel tank 12 has a rear side 65 which faces the rear handle 5 and a longitudinal side 64 which is oriented, approximately parallel to the plane of the guide bar 16 (FIG. 2) and on which the tank cap 13 is provided. The anti-vibration element 19 extends upward from the plane of the upper side 63 of the fuel tank 12. At the end which faces away from the fuel tank 12, a second holder 29 is fixed on the anti-vibration element 19 which is configured as a helical spring. Just like the first holder 22, the second holder 29 is screwed into the helical spring of the anti-vibration element 19. The second holder 29 is fixed by way of a fastening screw 31 on a fastening element 30 which is part of the engine housing 92 (FIGS. 1 and 2).

A first connection stub 27 is arranged on the upper side 63 of the fuel tank 12. An intake line 24 is connected to the first connection stub 27. Moreover, a second connection stub 28 is provided on the upper side 63 of the fuel tank 12. The second connection stub 28 can serve to connect a return line from a fuel valve. The intake line 24 opens into the pump housing 21. Moreover, a fuel line 25 for feeding fuel to a fuel valve and a pulse line 26 for connection to a crankcase of the internal combustion engine 18 are connected to the pump housing 21.

Figure 5:
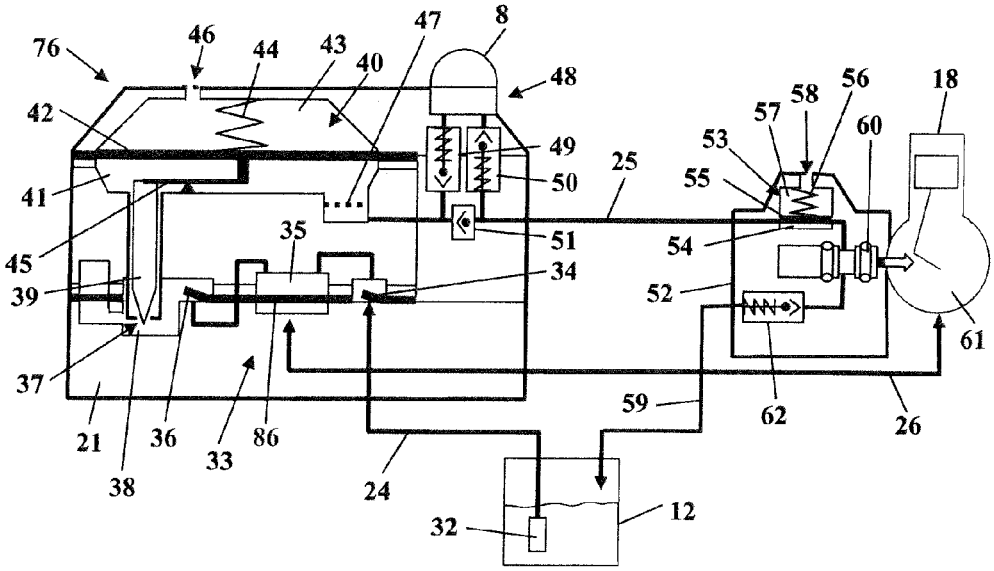
FIG. 5 is a schematic showing the fuel system of the chain saw of FIG. 1.

FIG. 5 shows the configuration of the fuel system in detail. A suction head 32 which is connected to the intake line 24 is arranged in the fuel tank 12. A fuel pump 33, which sucks in the fuel via the suction head 32 and the intake line 24, is arranged in the pump housing 21. The fuel pump 33 is driven by the fluctuating pressure in a crankcase 61 of the internal combustion engine 18. However, the fuel pump 33 can also be driven in another way by the internal combustion engine 18. The fuel pump 33 is connected to the interior of the crankcase 61 via the pulse line 26. The fuel which is sucked in via the intake line 24 opens via an intake valve 34 of the fuel pump 33 into a pump space 35. The pump space 35 is delimited by a pump diaphragm 86 which is deflected depending on the fluctuating crankcase pressure and, as a result, sucks in the fuel via the intake valve 34 into the pump space 35 and expels it via a pressure valve 36 into an accumulator space 38 which is arranged so as to be connected downstream of the fuel pump 33.

The accumulator space 38 is connected via an inlet valve 37 to a regulating chamber 41 of a pressure regulator 40. The regulating chamber 41 is delimited by a regulating diaphragm 42, which separates the regulating chamber 41 from a rear space 43. The regulating diaphragm 42 is prestressed by a spring 44. The inlet valve 37 has a valve needle 39 which is mounted on a lever 45. The lever 45 couples the position of the regulating diaphragm 42 to the position of the inlet valve 37. If the pressure in the regulating chamber 41 drops, the regulating diaphragm 42 is deflected toward the regulating chamber 41. This movement opens the inlet valve 37, with the result that fuel flows out of the accumulator space 38 into the regulating chamber 41 until the pressure in the regulating chamber 41 is so high that the regulating diaphragm 42 closes the inlet valve 37 again via the lever 45. The rear space 43 is leaded via an opening 46 with a reference pressure, advantageously with the ambient pressure.

The regulating chamber 41 is connected via the fuel line 25 to a pressure damper 53 and a fuel valve 60. A fuel screen 47 is arranged at the outlet from the regulating chamber 41. Moreover, a delivery pump 48 which comprises the pump bellows 8, an inlet valve 49 and an outlet valve 50 is arranged in the pump housing 21. A check valve 51 which closes in the flow direction from the pressure damper 53 to the pressure regulator 40 is arranged downstream of the branch to the inlet valve 49 and upstream of the opening of the outlet valve 50 into the fuel line 25. When the pump bellows 8 is actuated, fuel is pressed out of the interior of the pump bellows 8 via the outlet valve 50 into the fuel line 25. When the pump bellows 8 is let go, fuel is sucked out of the regulating chamber 41 via the inlet valve 49 into the pump bellows 8. The delivery pump 48 serves to flood the fuel system before starting of the internal combustion engine 18. This ensures that there is fuel at the fuel valve 50 during starting of the internal combustion engine 18. The fuel pump 33 cannot deliver fuel until the internal combustion engine 18 is running, since it is driven by the fluctuating pressure in the crankcase 61.

The fuel pump 33, the pressure regulator 40 and the delivery pump 48 are arranged in the common pump housing 21 and form an assembly 76 which is arranged in the depression 20 (FIG. 3) of the fuel tank 12. As a result, firstly satisfactory cooling of the assembly 76 and secondly an arrangement in the vicinity of the fuel level in the fuel tank 12 are achieved, with the result that there is only a small geodetic height difference between the assembly 76 and the fuel level in the fuel tank 12. As a result, the pressure difference to be overcome on account of a height difference between the fuel tank 12 and the assembly 76 is kept low.

The pressure damper 53 is arranged together with the fuel valve 60 in a common valve holder 52. The pressure damper 53 is advantageously arranged immediately adjacently to the fuel valve 60 in the fuel line 25. The fuel valve 60 advantageously feeds the fuel into the crankcase 61. The valve holder 52 can be fixed on the crankcase 61.

The pressure damper 53 has a damping space 54, into which fuel flows from the fuel line 25. The damping space 54 is delimited by a damping diaphragm 55 which separates the damping space 54 from a rear space 57. The damping diaphragm 55 is prestressed by a spring 56. The prestressing force of the spring 56 defines the position of the damping diaphragm 55 at the operating pressure. The rear space 57 is loaded via an opening 58 with a reference pressure, advantageously the ambient pressure.

A relief line 59 leads from the fuel valve 60 back to the fuel tank 12. A nonreturn valve 62 is arranged in the relief line 59. The nonreturn valve 62 advantageously opens at a pressure which is somewhat greater than the operating pressure. As a result, a pressure can be generated at the fuel valve 60 by way of the manual delivery pump 48 during starting of the internal combustion engine 18, which pressure is somewhat greater than the operating pressure.

Figure 6:
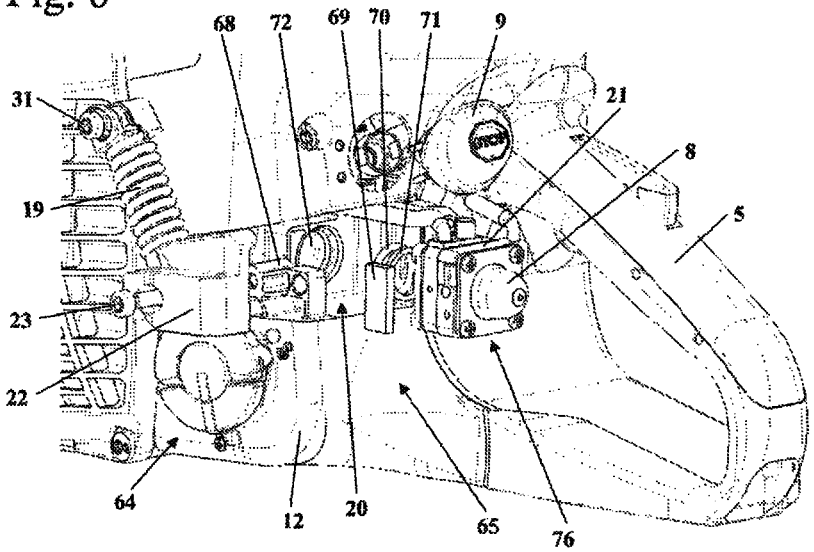
FIG. 6 shows details of an exploded view of the region of the operating elements of the chain saw of FIG. 1.
Figure 7:
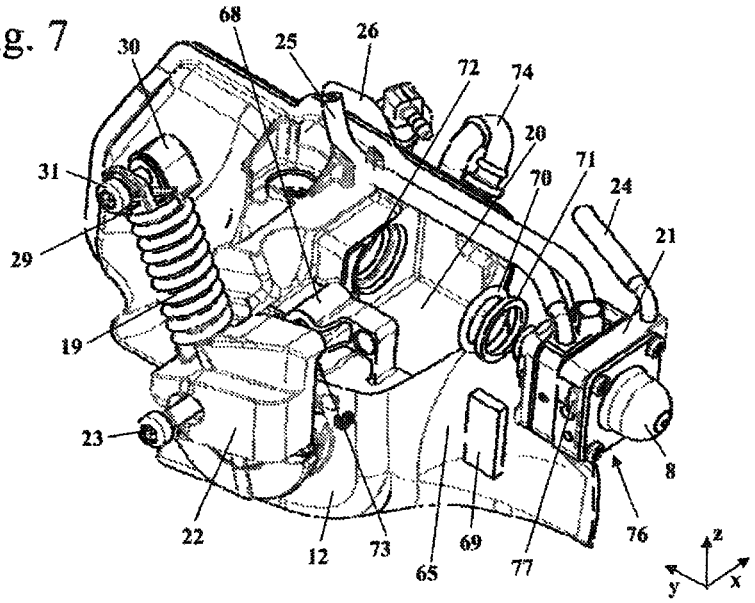
FIG. 7 is an exploded view of the region of the fuel pump of the handle housing of FIG. 4.

FIGS. 6 and 7 show the arrangement of the assembly 76 on the fuel tank 12 in detail. As FIG. 6 shows, the depression 20 is open toward the rear side 65 and toward the upper side 63 (FIG. 4). Toward the longitudinal side 64, the depression 20 is delimited by a fastening web 68. The holder 22 is screwed to the fastening web 68. An intermediate part 69 can be arranged between the pump housing 21 and the fastening web 68, which intermediate part 69 can serve to compensate for tolerances. The intermediate part 69 can also be provided as a pressure piece, with which the fastening screw 23 of the holder 22 presses against the pump housing 21 and additionally fixes the latter in a nonpositive manner.

As FIGS. 6 and 7 show, a receptacle 72 for a section of the pump housing 21 is provided on that wall of the depression 20 which, runs approximately parallel to the rear side 65. The pump housing 21 is supported on the edge of the receptacle 72 by way of a seal 70 and a washer 71.

As FIG. 7 shows, the pump housing 21 has a journal 77 which protrudes laterally in the first spatial direction (x), in the direction of the holder 22. The holder 22 engages over the journal 77 and, as a result, secures the position of the pump housing 21 in the second spatial direction (y). As a result, the pump housing 21 is fixed in the depression 20 toward the rear side 65. Moreover, the holder 22 has a holding contour 73 which is of rounded configuration in accordance with an upper edge of the pump housing 21 and engages over the pump housing 21 in the third spatial direction (z). As a result, the pump housing 21 is fixed in the depression 20 in the third spatial direction (z). Nonpositive fixing of the pump housing 21 in the spatial directions y and z is achieved via the holder 22. In the first spatial direction (x), the position of the pump housing 21 is secured by the fastening web 68.

FIG. 7 shows only a part shell of the handle housing 2. As a result, a fuel hose 74 which is arranged in the fuel tank 12 is visible in this view. The arrangement of the fuel hose 74 in the fuel tank 12 is also shown in FIG. 8.

Figure 8:
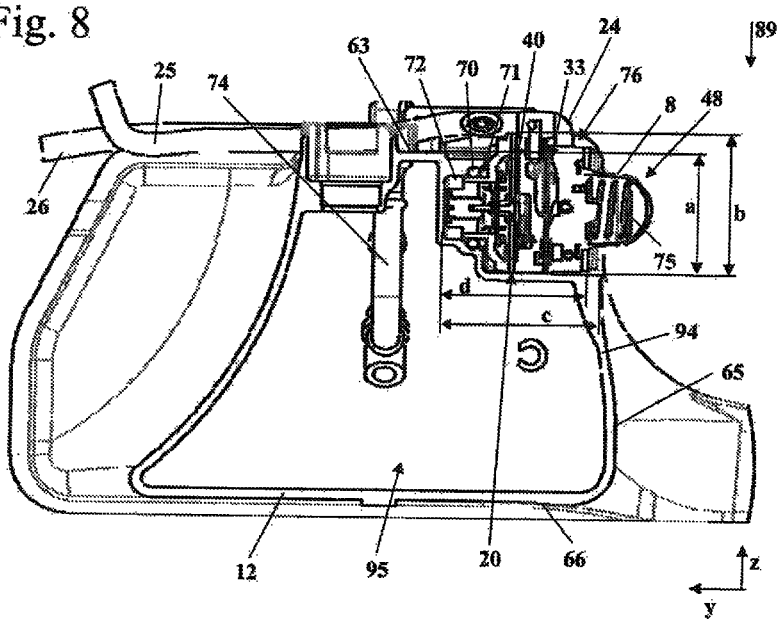
FIG. 8 is a section view through the handle housing in the region of the fuel pump.

FIG. 8 shows the arrangement of the assembly 76 and the design of the depression 20 in detail. As FIG. 8 shows, the fuel tank 12 has a tank wall 94 which delimits a tank interior 95. The fuel is arranged in the tank interior 95 during operation. The assembly 76 is arranged on the tank wall 94. The pump housing 21 bears against the tank wall 94. As a result, heat which is input into the assembly 76 can be dissipated satisfactorily to the fuel tank 12. The depression 20 has a depth (a) which is measured in the direction of action 89 of gravity. Here, the depth (a) is measured from the uppermost region of the upper side 63. The assembly 76 has a height (b) which is measured in the direction of action 89 of gravity, that is, in the spatial direction (z), and is somewhat greater than the depth (a). The assembly 76 projects slightly beyond that region of the tank wall 94 which forms the upper side 63 of the fuel tank 12. The depth (a) is advantageously at least approximately 50% of the height (b). The depth (a) is, in particular, at least approximately 70%, particularly advantageously at least approximately 80% of the height (b). As a result, in the parked position 67 (FIG. 2), the assembly 76 is arranged comparatively close to the level of the fuel in the fuel tank 12, with the result that only a small height difference and therefore only a small hydrostatic pressure difference have to be overcome. The arrangement in the region of the upper side 63 results in an advantageous arrangement of intake line 24, fuel line 25 and pulse line 26. The lines can be laid on the upper side 63 of the fuel tank 12. This results in short line paths.

As FIG. 8 shows, the pump housing 21 has a width (d) which is measured in the spatial direction (y), that is, in the longitudinal direction 91 of the chain saw 1, and is smaller than the length (c) of the depression 20, which length (c) is measured in the spatial direction (y). As a result, the pump housing 21 does not project beyond the fuel tank 12 on the rear side 65 of the fuel tank 12. Merely the pump bellows 8 projects beyond the plane which is defined by the rear side 65 of the fuel tank 12.

FIG. 8 also shows the underside 66 of the fuel tank 12. In the usual parked position 67, the underside 66 is that side of the fuel tank 12 which lies at the bottom. It can also be provided to arrange the assembly 76 adjacently to the underside 66 of the fuel tank 12 or in a central position between the upper side 63 and the underside 66. In the parked position 67, at least approximately 50% of the height (b) of the assembly 76, in relation to the direction of action 89 of gravity, is advantageously arranged above the lowermost region of the underside 66 and below the uppermost region of the upper side 63 of the fuel tank 12. Here, the upper side 63 and the underside 66 are formed by the tank wall 94, that is, by a wall which delimits the tank interior 95.

Figure 9:
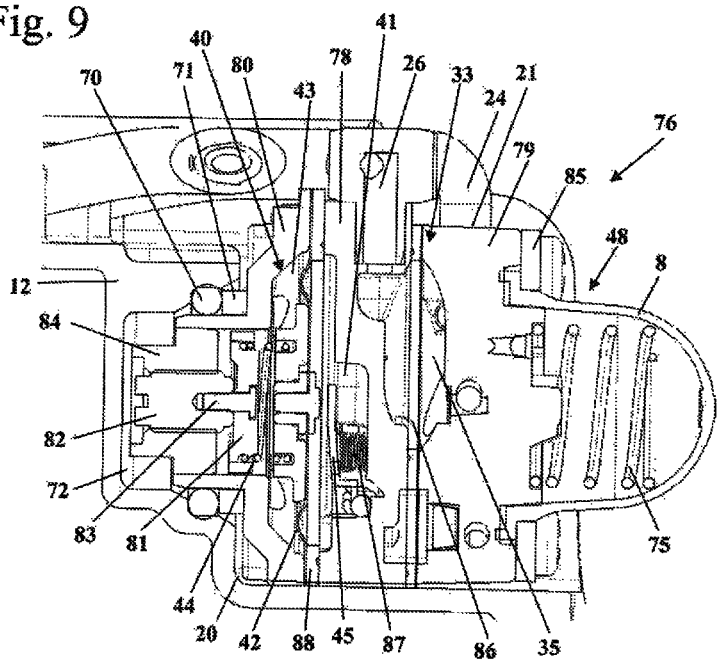
FIG. 9 shows the region of the fuel pump of FIG. 8 in an enlarged illustration; and, FIGS. 10 and 11 show details of sectional schematics of the region of the fuel pump in further exemplary embodiments of the chain saw of FIG. 1.

FIG. 9 shows the construction of the assembly 76 in detail. The pump housing 21 has a housing bottom 80 which projects into the receptacle 72. The seal 70 and the washer 71 are arranged between the housing bottom 80 and the wall of the fuel tank 12. The bottom 80 delimits the pressure regulator 40. A bottom part 84 is fixed in the bottom 80, into which bottom part 84 an adjusting screw 82 is screwed. A fastening bolt 83 which is held rotatably in a supporting plate 81 is fixed on the adjusting screw 82. The spring 44 which prestresses the regulating diaphragm 42 is supported on the supporting plate 81. The prestress of the spring 44 and therefore the operating pressure of the fuel system can be set via the adjusting screw 82. The housing bottom 80 delimits the rear space 43 of the pressure regulator 40.

The pump housing 21 has a housing main body 78 which is separated from the housing bottom 80 by the regulating diaphragm 42 and a seal 88. The seal 88 can also be integrated on the regulating diaphragm 42. The regulating chamber 41 is formed in the housing main body 78 on the side which faces the housing bottom 80. The lever 45 is mounted in the regulating chamber 41. The lever 45 is loaded by a spring 87. A housing upper part 79 is arranged on that side of the housing main body which lies opposite the housing bottom 80. The pulse line 26 opens at the housing main body 78 on the side which faces the housing upper part 79. The pump diaphragm 86 of the fuel pump 33 is arranged between the housing main body 78 and the housing upper part 79. The pump space 35 is formed in the housing upper part 79. The pump bellows 8 is held on the housing upper part 79 on the side which faces away from the housing main body 78. The pump bellows 8 is fixed by a housing cover 85 which is screwed to the housing upper part 79. A spring 75 is arranged in the pump bellows 8, which spring 75 spring-loads the pump bellows 8 into its non-actuated position and ensures that the pump bellows 8 returns into its initial position after the actuation.

Figure 10:
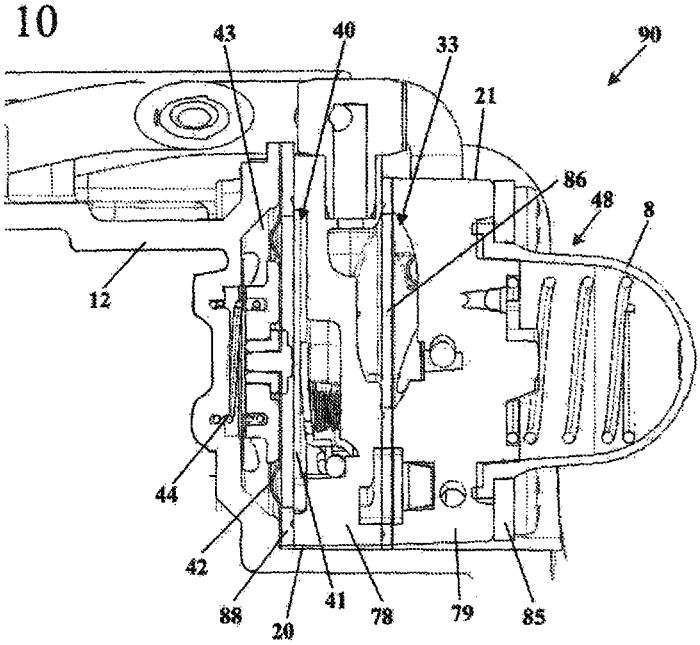

FIG. 10 shows an exemplary embodiment of an assembly 90 which is arranged on the fuel tank 12. Here, identical designations denote identical elements as in the preceding figures. The assembly 90 has a pump housing 21, in which a pressure regulator 40, a fuel pump 33 and a delivery pump 48 which is to be actuated manually are arranged. The pump housing 21 has a housing main body 78, a housing upper part 79 and a housing cover 85. The housing bottom which delimits the rear space 43 of the pressure regulator 40 is formed by the fuel tank 12. The spring 44 which prestresses the regulating diaphragm 42 is supported on the fuel tank 12. As a result, a separate housing bottom 80 can be dispensed with.

Figure 11:
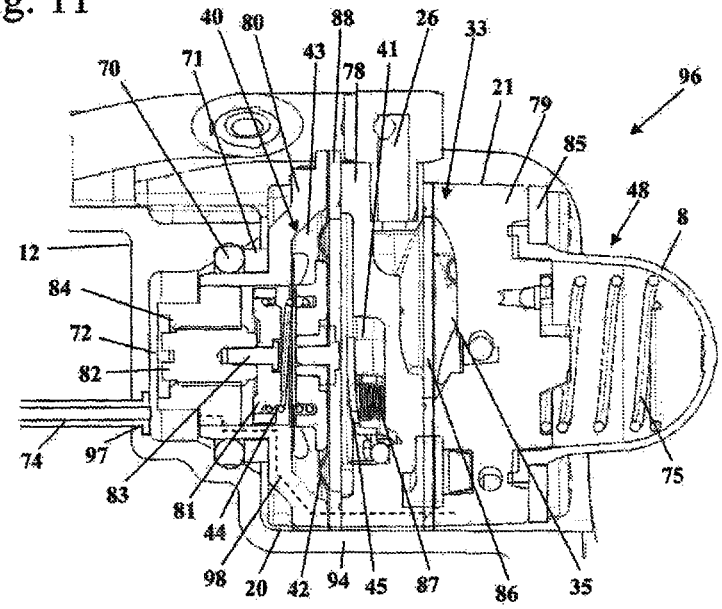

It can also be provided to provide the intake line 24 directly between the pump housing 21 and the adjoining wall of the fuel tank 12. FIG. 11 shows an exemplary embodiment of an assembly 96, the construction of which corresponds substantially to that of the assembly 76. Identical designations denote elements which correspond to one another. The assembly 96 is arranged in the depression 20 on the tank wall 94. In the region of the receptacle 72, the tank wall 94 has a connection opening 97 within the seal 70, in which connection opening 97 the fuel hose 74 can be held. An intake line 98 is integrated into the pump housing 21, which intake line 98 is shown diagrammatically in FIG. 11 and connects the region of the pump housing 21 which is arranged in the receptacle 72 to the fuel pump 33. The fuel pump 33 can suck in fuel from the tank interior 95 via the intake line 98, the interior of the receptacle 72, the connection opening 97 and the fuel hose 74. A separate hose which serves as intake line can be dispensed with as a result. This results in a simple construction. The receptacle 72 can be sealed in a simple way with respect to the surroundings via the seal 70 and the washer 71.

It is understood that the foregoing description is that of the preferred embodiments of the invention and that various changes and modifications may be made thereto without departing from the spirit and scope of the invention as defined in the appended claims.

What is claimed is:

1. A work apparatus comprising:
a work tool;
a combustion engine configured to drive said work tool;
a fuel tank having a tank wall delimiting a tank interior;
a fuel pump configured to be driven by said combustion engine and to convey fuel from said fuel tank to said combustion engine;
a feed pump configured to be manually actuated by a user;
a component including said fuel pump and said feed pump;
said component further including a pump housing for accommodating said fuel pump and said feed pump therein;
a motor housing for accommodating said combustion engine therein;
a handle housing configured to include at least one handle;
said fuel tank being configured to be formed on said handle housing;
said component being mounted outside of said fuel tank and being arranged on said handle housing so as to cause said pump housing, said fuel pump and said feed pump to be vibration decoupled from said motor housing; and,
said pump housing of said component being mounted so as to be at least partially lying against said tank wall;
said fuel tank having a recess formed in said tank wall thereof; and,
said component being arranged in said recess.

2. The work apparatus of claim 1, wherein said fuel tank has the following: an upper side arranged topside in a usual rest position of said work apparatus; a rear side facing away from said work tool; a lower side arranged bottom side in said usual rest position; and, at least one longitudinal side.

3. The work apparatus of claim 2, wherein said component has a height (b) measured in said rest position in the effective direction of gravitational force; and, at least 50% of said height (b) lies below the uppermost region of said upper side when said work apparatus is in said rest position and above the lowest region of said lower side of said fuel tank.

4. The work apparatus of claim 2, wherein said recess extends on said upper side and rear side of said fuel tank.

5. The work apparatus of claim 1, wherein said fuel tank has a side facing away from said combustion engine; and, said recess is arranged on said side facing away from said combustion engine.

6. The work apparatus of claim 1, wherein said component is held form tight on said fuel tank.

7. The work apparatus of claim 6, further comprising a holder for holding said component form tight on said fuel tank; and, said holder being configured to fix said component in position in at least two mutually perpendicular spatial directions.

8. The work apparatus of claim 6, further comprising at least one anti-vibration element; said fuel tank being held vibration decoupled from said combustion engine via said anti-vibration element; and, said anti-vibration element being fixed on said holder.

9. The work apparatus of claim 1, wherein said feed pump includes a pump bellows to be actuated by the user.

10. The work apparatus of claim 9, wherein said pump bellows is arranged to be spatially close to at least another operator-controlled element of said work apparatus.

11. The work apparatus of claim 1, wherein said fuel pump is a diaphragm pump driven by a fluctuating pressure in the crankcase of said combustion engine.

12. The work apparatus of claim 1, wherein said component includes a pump housing and a pressure controller arranged in said pump housing; said fuel is pumped in a pumping direction and said pressure controller is mounted in said pumping direction downstream of said fuel pump; and, said pressure controller includes a diaphragm which separates a control chamber from a rear space.

13. The work apparatus of claim 12, wherein said rear space is at least partially delimited by said fuel tank.

14. The work apparatus of claim 1, wherein said tank wall has a connecting opening adjacent said component; and, said component has a suction line integrated therein which connects said tank interior to said fuel pump.

15. The work apparatus of claim 1, further comprising A work apparatus comprising:

a work tool;

a combustion engine configured to drive said work tool;

a fuel tank having a tank wall delimiting a tank interior;

a fuel pump configured to be driven by said combustion engine and to convey fuel from said fuel tank to said combustion engine;

a feed pump configured to be manually actuated by a user;

a fuel valve for supplying fuel conveyed by said fuel pump to said combustion engine;

a component including said fuel pump and said feed pump;

said fuel valve being configured to be separate from said component and being mounted on said combustion engine;

said component being arranged outside of said fuel tank and being mounted on said tank wall;

said fuel tank having a recess formed in said tank wall thereof;

said component being arranged at least partially in said recess and mounted against said tank wall;

a handle housing and said fuel tank being integrated into said handle housing;

a motor housing for accommodating said combustion engine therein, said handle housing and said motor housing conjointly defining an interface; and, vibration decoupling elements mounted at said interface for vibration decoupling said motor housing from said handle housing.

16. A work apparatus comprising:

a work tool;

a combustion engine configured to drive said work tool;

a fuel tank having a tank wall delimiting a tank interior;

a fuel pump configured to be driven by said combustion engine and to convey fuel from said fuel tank to said combustion engine;

a feed pump configured to be manually actuated by a user;

a fuel valve for supplying fuel conveyed by said fuel pump to said combustion engine;

a component including said fuel pump and said feed pump;

said fuel valve being configured to be separate from said component and being mounted on said combustion engine;

said component being arranged outside of said fuel tank and being mounted on said tank wall;

said fuel tank having a recess formed in said tank wall thereof;

said component being arranged at least partially in said recess and mounted against said tank wall; and, said component includes including a pump housing which borders on said fuel pump and said feed pump.

17. The work apparatus of claim 16, wherein said work apparatus defines a longitudinal direction; and, said pump housing extends completely in said recess in said longitudinal direction.

18. The work apparatus of claim 16, wherein said pump housing is formed, at least in part, on said fuel tank.

19. A work apparatus comprising:

a work tool;

a combustion engine configured to drive said work tool;

a fuel tank having a tank wall delimiting a tank interior;

a fuel pump configured to be driven by said combustion engine and to convey fuel from said fuel tank to said combustion engine;

a feed pump configured to be manually actuated by a user;

a component including said fuel pump and said feed pump;

said component further including a pump housing for accommodating said fuel pump and said feed pump therein;

a motor housing for accommodating said combustion engine therein;

a handle housing configured to include at least one handle;

said fuel tank being configured to be formed on said handle housing;

said component being mounted outside of said fuel tank and being arranged on said handle housing so as to cause said pump housing, said fuel pump and said feed pump to be vibration decoupled from said motor housing; and, said pump housing of said component being mounted so as to be at least partially lying against said tank wall.

* * * * *

UNITED STATES PATENT AND TRADEMARK OFFICE

CERTIFICATE OF CORRECTION

PATENT NO. : 9,181,864 B2
APPLICATION NO. : 13/862162
DATED : November 10, 2015
INVENTOR(S) : J. Lank et al.

It is certified that error appears in the above-identified patent and that said Letters Patent is hereby corrected as shown below:

In the Specification

In column 1:
Line 15: delete "foe" and substitute -- be -- therefor.
Line 67: delete "front" and substitute -- from -- therefor.

In column 3:
Line 60: delete "lit" and substitute -- in -- therefor.

In column 4:
Line 25: delete "foe" and substitute -- be -- therefor.
Line 39: delete "wherein;" and substitute -- wherein: -- therefor.

In column 6:
Line 66: delete "leaded" and substitute -- loaded -- therefor.

In column 7:
Line 18: delete "50" and substitute -- 60 -- therefor.

In the Claims

In column 11:
Line 23: delete "The work apparatus of claim 1, further comprising".

Signed and Sealed this
Twenty-fourth Day of May, 2016

Michelle K. Lee

Michelle K. Lee
*Director of the United States Patent and Trademark Office*